US006871623B2

(12) United States Patent
Ohsawa et al.

(10) Patent No.: US 6,871,623 B2
(45) Date of Patent: Mar. 29, 2005

(54) WORKING MACHINE HAVING A SINGLE OPERATION UNIT

(75) Inventors: Hisato Ohsawa, Fussa (JP); Katsuya Tajima, Okayama (JP); Fujio Kobayashi, Hachioji (JP)

(73) Assignee: Kioritz Corp., Tokyo (JP)

( * ) Notice: Subject to any disclaimer, the term of this patent is extended or adjusted under 35 U.S.C. 154(b) by 35 days.

(21) Appl. No.: 10/273,287

(22) Filed: Oct. 18, 2002

(65) Prior Publication Data

US 2003/0075132 A1 Apr. 24, 2003

(30) Foreign Application Priority Data

Oct. 19, 2001 (JP) ..... 2001-322333

(51) Int. Cl.[7] ..... F02M 1/00
(52) U.S. Cl. ..... 123/179.18; 261/52
(58) Field of Search ..... 123/179.18, 179.5, 123/179.16; 261/52

(56) References Cited

U.S. PATENT DOCUMENTS 4,079,708 A * 3/1978 Wieland et al. ..... 123/376
5,215,049 A * 6/1993 Wolf ..... 123/179.18
5,693,264 A * 12/1997 Fricke ..... 261/64.6
5,927,241 A * 7/1999 Dahlberg et al. ..... 123/179.5

* cited by examiner

*Primary Examiner*—Mahmoud Gimie
*Assistant Examiner*—Arnold Castro
(74) *Attorney, Agent, or Firm*—Nixon Peabody, LLC; Donald R. Studebaker

(57) ABSTRACT

The present invention provides a working machine having an internal combustion engine. The working machine includes a single operation unit comprised of a rotatable body adapted to be selectively rotated between an engine-stop position, engine-start position and choke-activation position, a valve to be rotated about an rotation shaft, an arm attached to the rotation shaft and a link member adapted to be moved in its longitudinal direction to transmit the movement of the rotatable body to the arm. The link member has a distal end coupled with the arm and a proximal end coupled with the rotatable body, and extends between the distal and proximal ends. The rotatable body is formed with an elongated slot receiving the proximal end therein. When the rotatable body is rotated from the engine-stop position to the engine-start position, the proximal end is allowed to displace relative to the rotatable body along the elongated slot without causing any movement of the link member in the longitudinal direction. When the rotatable body is rotated from the engine-start position to the choke-activation position, the proximal end is restricted in its displacement along the elongated slot so that the link member is moved in the longitudinal direction to transmit the movement of the rotatable body to the arm.

17 Claims, 5 Drawing Sheets

WORKING MACHINE HAVING A SINGLE OPERATION UNIT

FIELD OF THE INVENTION

The present invention relates to a working machine driven by an internal combustion engine. In particular, the present invention relates to a working machine driven by an internal combustion engine and provided with a single operation unit for switching between stop, start and choke operations of the internal combustion engine.

BACKGROUND OF THE INVENTION

A working machine equipped with an internal combustion engine as a power source typically includes a choke-valve open/close mechanism for opening and closing a choke valve of an intake system of the engine, a throttle-valve open/close mechanism for opening and closing a throttle valve of the intake system, an interlock mechanism for interlocking the choke-valve open/close mechanism and the throttle-valve open/close mechanism, and a release mechanism for releasing the interlock mechanism. For starting the internal combustion engine, an electric switch is moved from a stop position to a start position to electrically turn on an ignition unit. Additionally, if the internal combustion engine is cold, the engine is started after activating the choke-valve open/close mechanism to close the choke valve. In this operation, the choke-valve open/close mechanism is interlocked with the throttle-valve open/close mechanism by the interlock mechanism to allow the throttle valve to be partially opened for the operation-period of the choke-valve open/close mechanism.

For example, Japanese Patent Laid-open Publication No. 5-214972 discloses a chain saw, as a working machine, having a single operation unit for switching between stop, start and choke operations of an internal combustion engine. In the working machine, the operation unit is provided at the front end portion of a handle extending in the lengthwise direction of the body of the working machine. Further, a choke-valve open/close mechanism, a throttle-valve open/close mechanism and an interlock mechanism therefor are housed in an interior space of the rear end portion of the handle. These mechanisms are operationally coupled with the operation unit through a link mechanism to transmit the movement of the operation unit to the mechanisms provided at the rear end portion.

This working machine is highly advantageous in that the stop, start and choke operations of the internal combustion engine can be switched only by a single operation unit. However, the link mechanism provided inside the working machine has a complicated structure, resulting in an increased number of components, deteriorated workability during the assembly process and increased cost.

SUMMARY OF THE INVENTION

It is therefore an object of the present invention to provide a working machine having a single operation unit capable of switching between stop, start and choke operations of an internal combustion engine, with a simplified mechanism for transmitting operational movements.

In order to achieve the above object, according to a first aspect of the present invention, there is provided a working machine including an internal combustion engine serving as a power source. The working machine includes a single operation unit for switching between stop, start and choke operations of the engine, which includes a rotatable body capable of being rotationally moved according to a manual operation; a choke open/close mechanism for an intake system of the engine, which includes a choke valve, a choke shaft for rotating the choke valve, and an arm attached to the choke shaft; and a choke-activating link member adapted to be moved in its longitudinal direction to transmit the movement of the rotatable body to the arm so as to close the choke valve. The choke-activating link member has a distal end coupled with the arm and a proximal end coupled with the rotatable body, and extends between the distal and proximal ends. In the working machine, the rotatable body is adapted to be switchably moved in turn from a first rotational position for stopping the engine, through a second rotational position for allowing the engine to be started, to a third rotational position for activating the choke open/close mechanism. Further, the rotatable body is formed with an elongated slot which receives therein the proximal end such that when the rotatable body is rotated from the first rotational position to the second rotational position, the proximal end is allowed to displace relative to the rotatable body along the elongated slot without causing any movement of the choke-activating link member in the longitudinal direction. When the rotatable body is rotated from the second rotational position to the third rotational position, the proximal end is restricted in its displacement along the elongated slot so that the choke-activating link member is moved in the longitudinal direction in response to the rotational movement of the rotatable body to transmit the movement of the rotatable body to the arm.

The working machine according the first aspect of the present invention is operated as follows. The operation unit is first moved from the first rotational position or an engine-stop position for stopping the internal combustion engine to the second rotational position or an engine-start position for starting the engine. Through this operation, an ignition unit is turned on to allow the engine to be started. When the rotatable body is rotated from the first rotational position to the second rotational position, the proximal end of the choke-activating link member is allowed to displace relative to the rotatable body along the elongated slot of the rotatable body, that is, the proximal end of the choke-activating link member is not displaced relative to the body of the working machine. Thus, the choke-activating link member is not moved in the longitudinal direction. For example, if the internal combustion engine is cold, the operation unit will be further moved to the third position for activating the choke open/close mechanism. When the rotatable body is rotated from the second rotational position to the third rotational position, the proximal end is restricted in its displacement along the elongated slot so that the choke-activating link member is moved in the longitudinal direction in response to the movement of the rotatable body. Thus, the arm coupled with the distal end of the choke-activating link member is swung to rotate the choke shaft and close the choke valve. This facilitates the cold start of the internal combustion engine.

Thus, the first aspect of the present invention can provide a working machine having a simplified structure for reliably transmitting the movement of the operation unit to the choke open/close mechanism to facilitate its assemble process and achieve reduced cost.

According to a second aspect of the present invention, there is provided a working machine including an internal combustion engine serving as a power source therefor. The working machine includes a single operation unit for switching between stop, start and choke operations of the engine, which includes a rotatable body capable of being rotationally moved according to a manual operation; a choke open/close mechanism for an intake system of the engine, which includes a choke valve, a choke shaft for rotating the choke valve, and an arm attached to the choke shaft; and a choke-activating link member adapted to be moved in its longitudinal direction to transmit the movement of the rotatable body to the arm so as to close the choke valve. The choke-activating link member has a distal end coupled with the arm and a proximal end coupled with the rotatable body, and extends between the distal and proximal ends. In this working machine, the rotatable body is adapted to be switchably moved in turn from a first rotational position for stopping the engine, through a second rotational position for allowing the engine to be started, to a third rotational position for activating the choke open/close mechanism. Further, the rotatable body is formed with an elongated slot which receives therein the proximal end such that when the rotatable body is rotated from the first rotational position to the second rotational position, the proximal end is allowed to displace relative to and in the radial direction of the rotatable body along the elongated slot so as to cause a swing movement of the choke-activating link member about the distal end. When the rotatable body is rotated from the second rotational position to the third rotational position, the proximal end is restricted in its displacement along the elongated slot so that the choke-activating link member is moved in the longitudinal direction in response to the movement of the rotatable body to transmit the movement of the rotatable body to the arm.

In the working machine according to the second aspect of the present invention, when the rotatable body is rotated from the first rotational position to the second rotational position, the proximal end is allowed to displace relative to the rotatable body along the elongated slot so as to case only the swing movement of the choke-activating link member about the distal end. That is, the distal end of the choke-activating link member has substantially no movement. Thus, the arm attached to the choke shaft is not swung, and the choke valve is not closed. Further, when the rotatable body is rotated from the second rotational position to the third rotational position, the proximal end is restricted in its displacement along the elongated slot so that the movement of the rotatable body is transmitted to the choke-activating link member to move the choke-activating link member in the longitudinal direction so as to transmit the movement of the rotatable body to the arm.

Further, in order to achieve the above object, according to a third aspect of the present invention, there is provided a working machine including an internal combustion engine serving as a power source therefor. The working machine comprises: a single operation unit for switching between stop, start and choke operations of the engine, which includes a rotatable body capable of being rotationally moved according to a manual operation; a choke open/close mechanism for an intake system of the engine, which includes a choke valve, a choke shaft for rotating the choke valve, and an arm attached to the choke shaft; and a choke-activating link member adapted to be moved in its longitudinal direction to transmit the movement of the rotatable body to the arm so as to close the choke valve. The choke-activating link member having a distal end coupled with the arm and a proximal end coupled with the rotatable body, and extending in the crosswise direction with respect to the distal and proximal ends therebetween. In this working machine, the rotatable body is adapted to be switchably moved in turn from a first rotational position for stopping the engine, through a second rotational position for allowing the engine to be started, to a third rotational position for activating the choke open/close mechanism. Further, the rotatable body is formed with an elongated slot or escape hole extending in the crosswise direction. The elongated slot has a leading end zone located on a leading side with respect to the rotation direction of the rotatable body and a trailing end zone located on a trailing side with respect to the rotation direction. The rotatable body is adapted to receive therein the proximal end such that: when the rotatable body is located at the first rotational position, the proximal end is located in the leading end zone. When the rotatable body is rotated from the first rotational position to the second rotational position, the proximal end is moved from the leading end zone to the trailing end zone while displacing relative to and in the radial direction of the rotatable body along the elongated slot to cause a swing movement of the choke-activating link member about the distal end. When the rotatable body is rotated from the second rotational position to the third rotational position, the proximal end is held in the trailing end zone so that the choke-activating link member is moved in the longitudinal direction in response to the movement of the rotatable body to transmit the movement of the rotatable body to the arm.

In one embodiment of the present invention, the working machine further includes a throttle open/close mechanism for opening and closing a throttle valve of the intake system, an interlock mechanism for interlocking the throttle open/close mechanism and the choke open/close mechanism, and a release mechanism including a release lever for releasing the interlock mechanism. In this case, the operation unit and the release lever are disposed at the front end portion of a handle extending in the lengthwise direction of the working machine. The choke open/close mechanism, the throttle open/close mechanism and the interlock mechanism are housed in an interior space of the rear end portion of the handle. Further, the choke-activating link member is a rod-shaped member extending from the rotatable body to the arm attached to the choke shaft, in the lengthwise direction through the internal space of the handle. The release mechanism includes a rod-shaped throttle-releasing link member having a proximal end coupled with the release lever and a distal end coupled with the interlock mechanism, and extends in the longitudinal direction through the interior space of the handle along the choke-activating link member.

In another embodiment of the present invention, the operation unit further includes a guide portion for guiding the proximal end of the choke-activating link member from the leading end zone to the trailing end zone along the elongated slot when the rotatable body is moved from the first rotational position to the second rotational position, and for holding the proximal end of the choke-activating link member in the trailing end zone when the rotatable body is moved from the second rotational position to the third rotational position. Further, the rotatable body has a substantially circular shape. The leading end zone is located inward in the radial direction and on the leading side of the rotatable body, and the trailing end zone is located outward in the radial direction and on the trailing side of the rotatable body. The trailing end zone is spaced apart from the rotation center of the rotatable body by a first radial distance, and the elongated slot extends obliquely with respect to the radial direction from the leading end zone to the trailing end zone. Furthermore, the guide portion has a flat surface region extending straight in the radial direction of the rotatable body up to a position of a second radial distance derived by subtracting the outside dimension of the proximal end of the choke-activating link member from the first radial distance, and an arc surface region extending from the radially outer end of the flat surface region to the leading side of the rotatable body to form an arc having a radius of the second radial distance about the rotation center. In this case, when the rotatable body is located at the first rotational position, the proximal end of the choke-activating link member is located in the elongated slot on the trailing side with respect to the flat surface region. When the rotatable body is moved from the first rotational position to the third rotational position, the proximal end of the choke-activating link member is moved along the flat surface and arc surface regions.

Thus, the present invention can provide a working machine capable of switching an internal combustion engine between stop, start and choke operations by a single operation unit, with a simplified mechanism for transmitting operational movements.

Other features and advantages of the present invention will be apparent from the accompanying drawings and from the detailed description.

DESCRIPTION OF THE PREFERRED EMBODIMENTS

With reference to the drawings, a working machine according to one embodiment of the present invention will now be desribed. In this embodiment, the present invention will be described as a chain saw being one example of the working machine.

Figure 1:
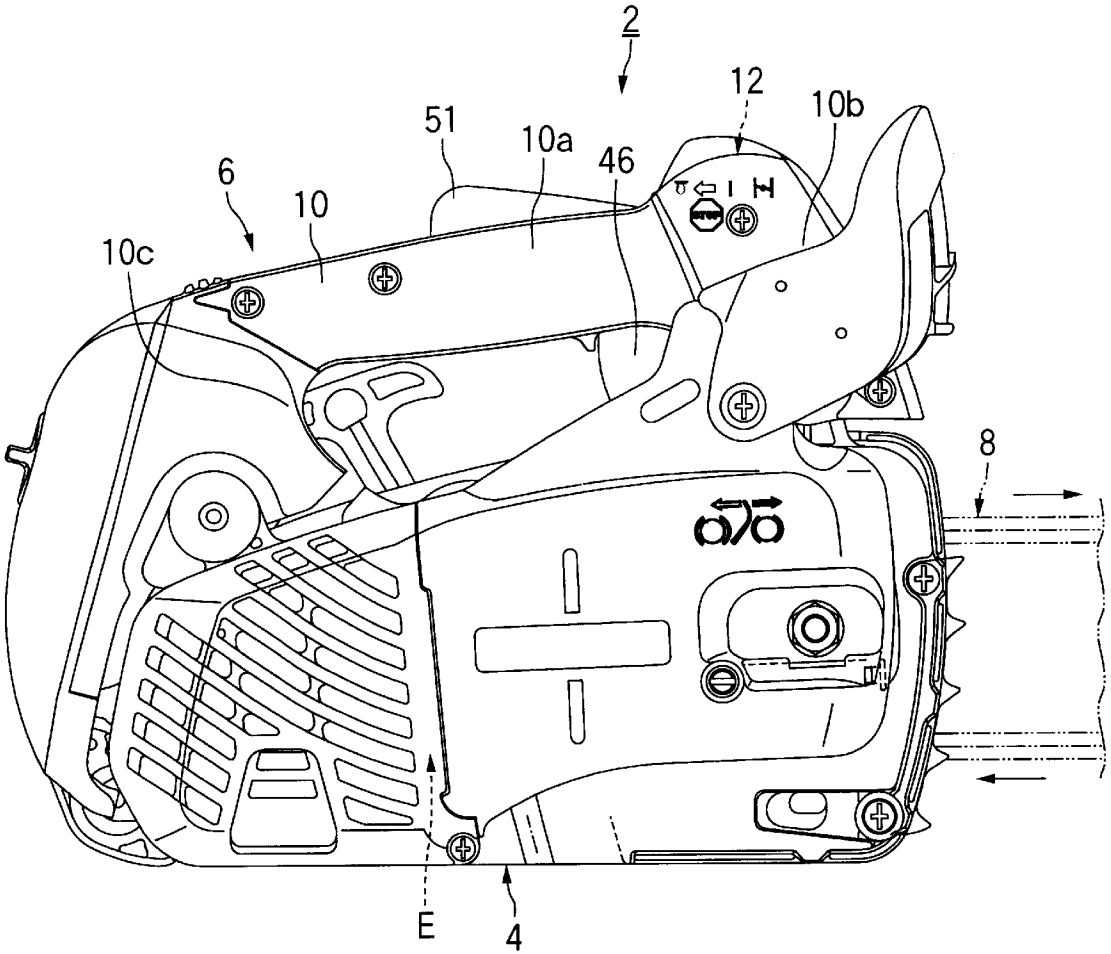
FIG. 1 is a right side outer view of a chain saw according to one embodiment of the present invention.

FIG. 1 is a right side outer view of a chain saw, more particularly a top handle chain saw, according to an embodiment of the present invention. In this figure, a chain saw bar portion, i.e., working member, is indicated by the two-dot chain lines.

As shown in FIG. 1, the working machine or the chain saw 2 comprises a main body 6 having a housing 4, an internal combustion engine E, such as an air-cooled 2-cycle gasoline engine housed in the house 4, and a chain saw bar portion 8 extending forward from the main body 6. A handle 10 to be gripped by an operator's right hand is provided on the upper surface of the housing 4 of the main body extending in the lengthwise direction of the working machine. A single operation unit 12 is provided on the upper surface of the front end portion 10*b* of the handle 10. The single operation unit 12 is adapted to switch between stop, start and choke operations of the internal combustion engine E. The handle 10 is provided on the upper surface of the housing 4 of the main body to form an inverted-U shape, so as to provide a gripping portion 10*a* extending straight in the lengthwise direction to allow an operator to get a firm grip there, the front end portion 10*b* extending vertically at the front end thereof, and a rear end portion 10*c* extending vertically at the rear end thereof.

Figure 2:
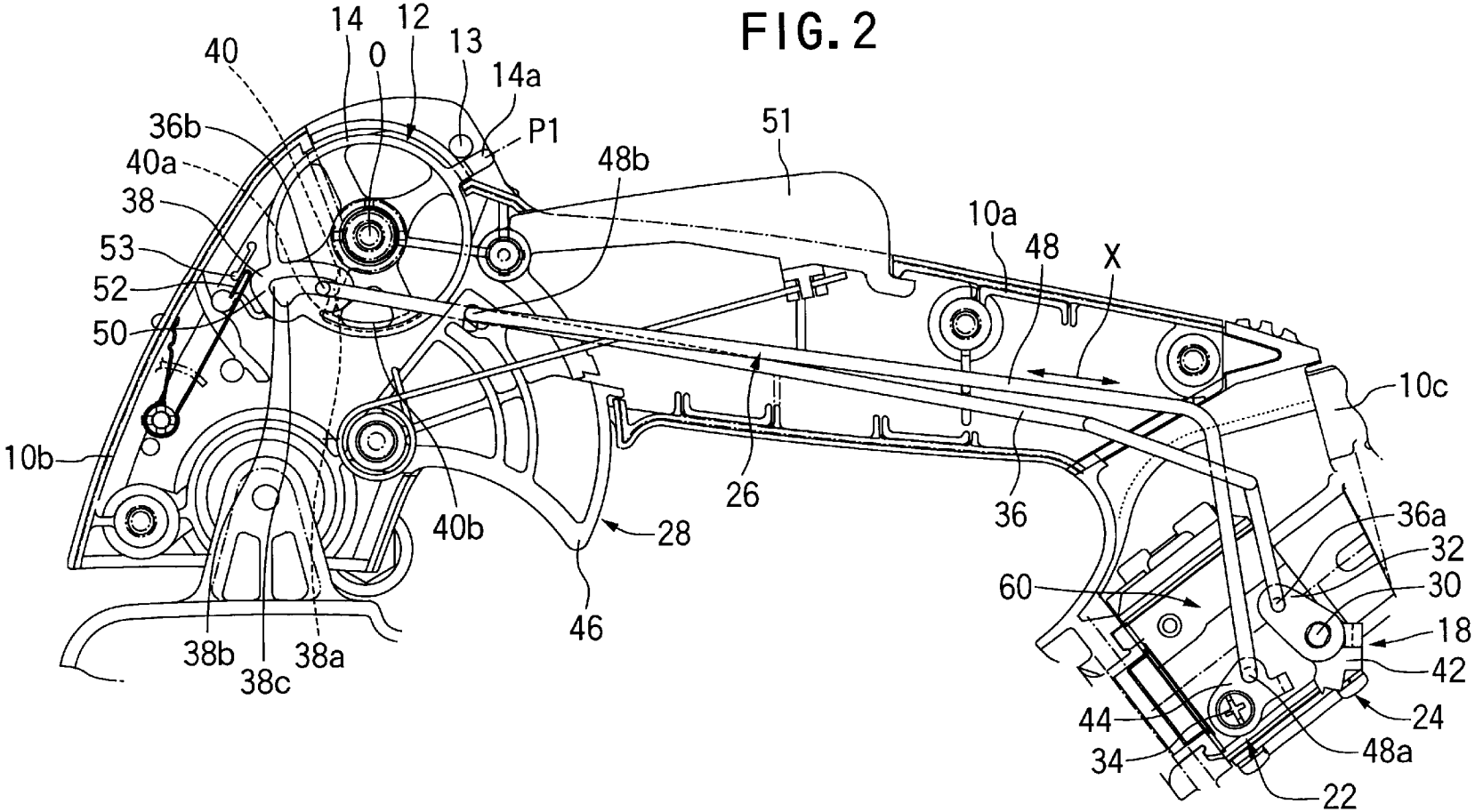
FIG. 2 is an enlarged left side view of the internal mechanisms in a handle of the chain saw.
Figure 3:
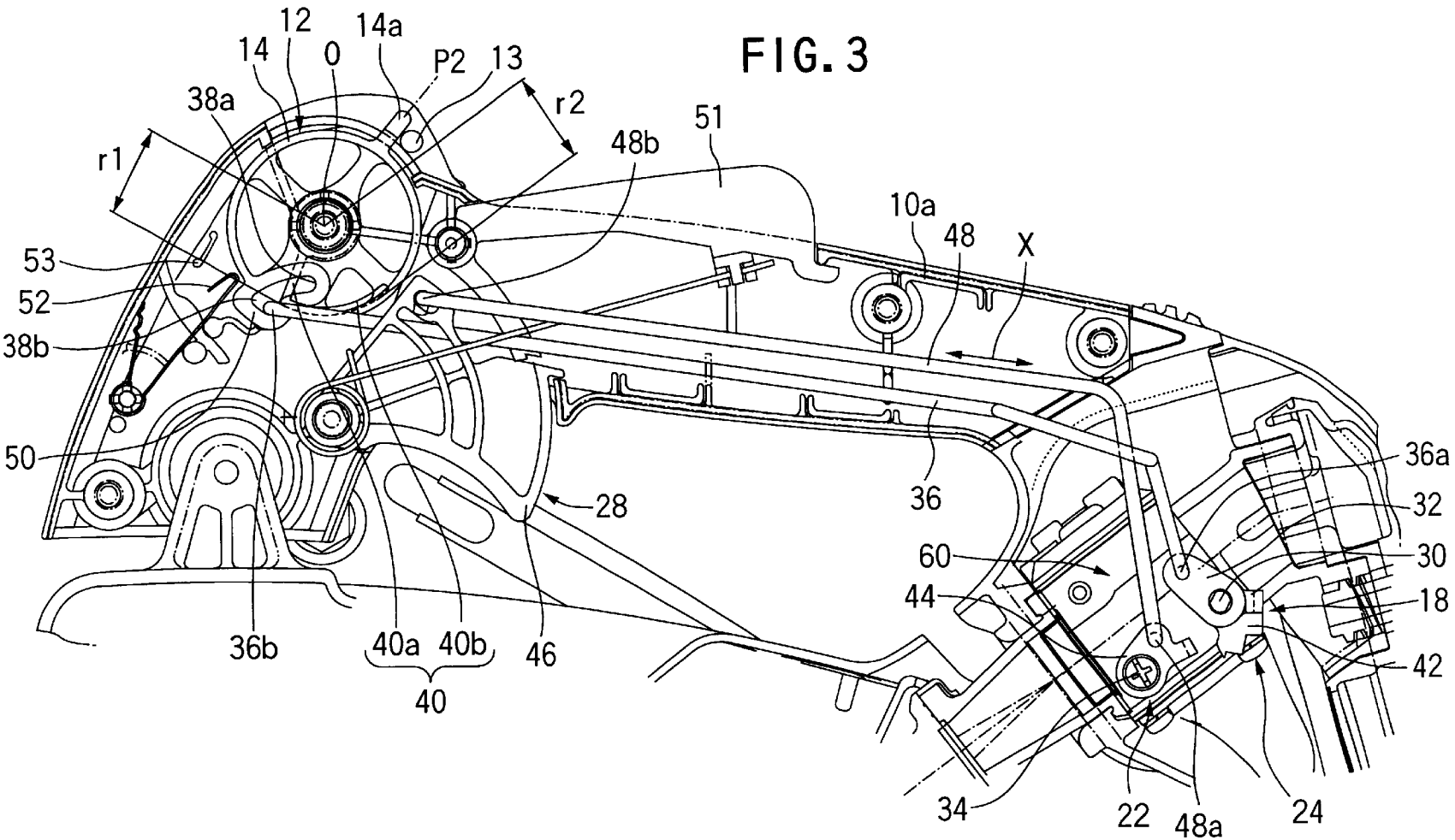
FIG. 3 is an enlarged left side view of the internal mechanisms in the handle of the chain saw, wherein the operation unit is located at an engine-start position.
Figure 4:
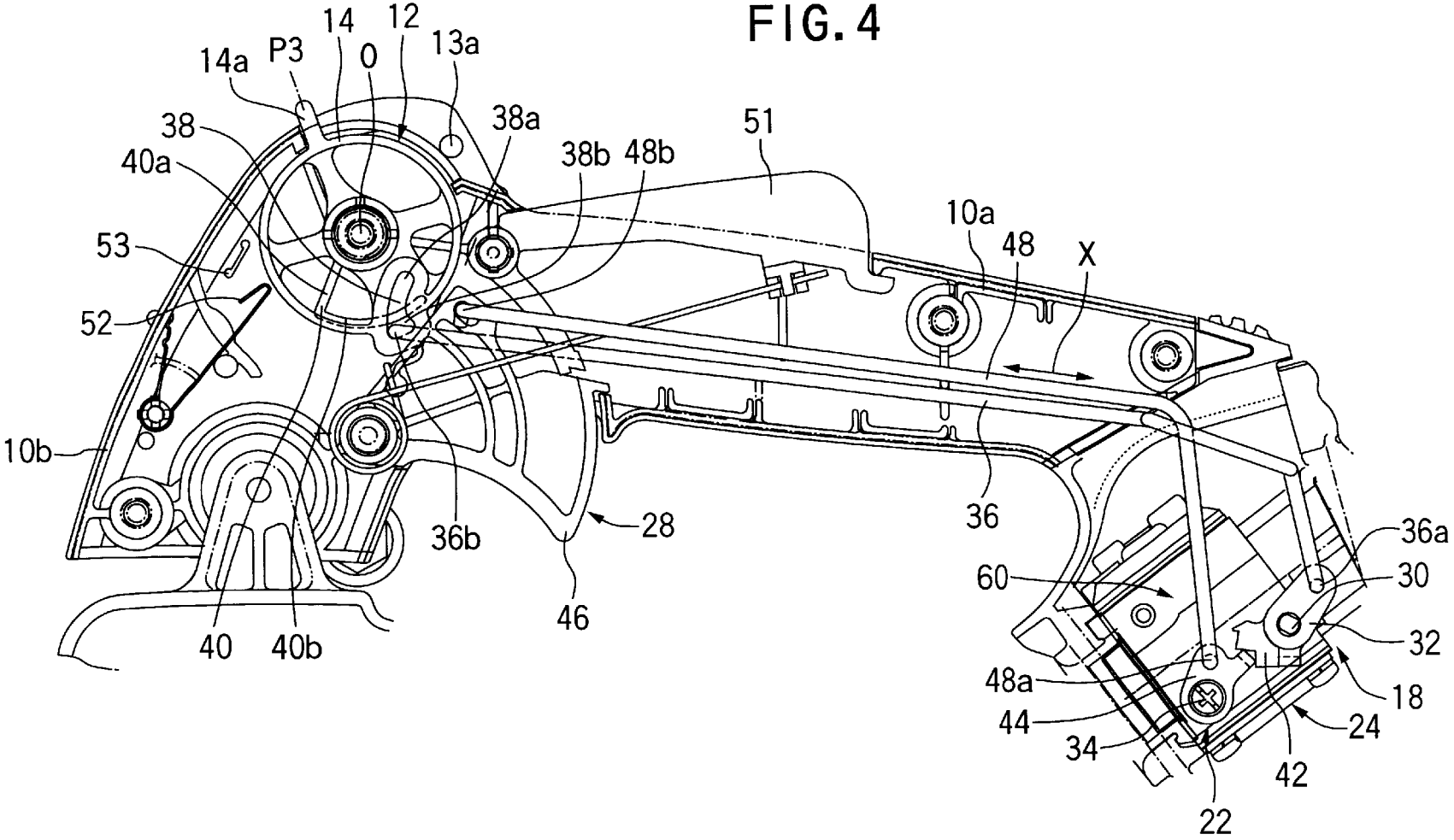
FIG. 4 is an enlarged left side view of the internal mechanisms in the handle of the chain saw, wherein the operation unit is located at a choke-activation position.
Figure 5A:
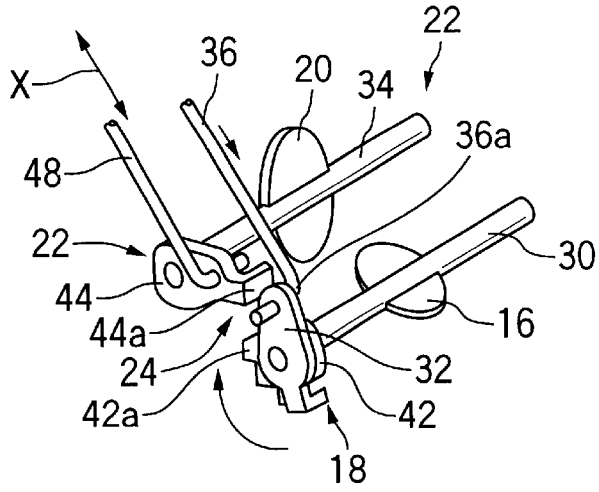
FIGS. 5A–5C are explanatory diagrams of the operations of a choke open/close mechanism, throttle-valve open/close mechanism and an interlock mechanism therefor.
Figure 5B:
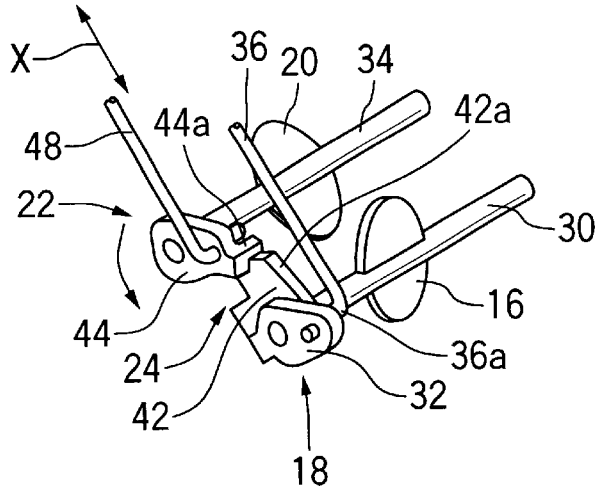
Figure 5C:
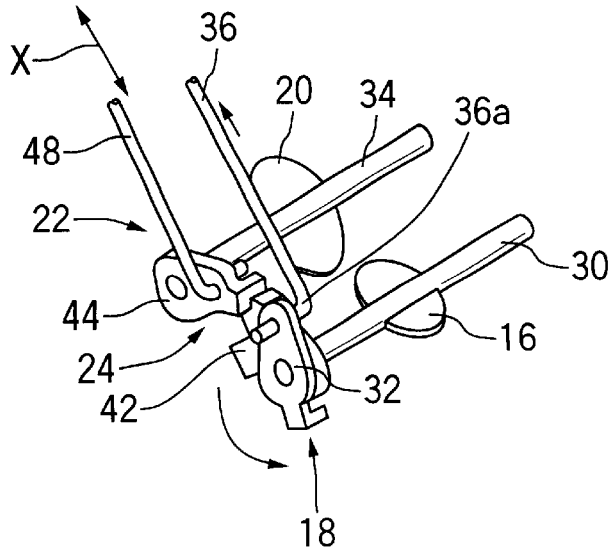

FIGS. 2 to 4 are enlarged left side views of internal mechanisms located within the handle of the chain saw, wherein FIG. 2 shows the state when the operation unit is located at an engine-stop position, FIG. 3 showing the state when the operation unit is located at an engine-start position, and FIG. 4 showing the state when the operation unit is located at a choke-activation position. FIGS. 2 to 4 are illustrated back to front with respect to FIG. 1, and thereby the left-hand side and right-hand side of FIGS. 2 to 4 correspond to the front side and rear side of the chain saw in FIG. 1, respectively. FIGS. 5A–5C show the operations of a choke open/close mechanism, throttle-valve open/close mechanism and an interlock mechanism therebetween.

As shown in FIG. 2, the operation unit 12 is disposed in the interior space of the front end portion 10*b* of the handle 10. The operation unit 12 includes a rotatable body 14 capable of being rotationally moved according to manual operation. More specifically, the rotatable body 14 is adapted to be switchably moved from the near side to the distant side with respective to the grip portion 10*a*, or from the rear side to front side of the chain saw along the longitudinal direction X of the grip portion 10*a*. Body 14 moves from a first rotational position (engine-stop position as shown in FIG. 2) P1 for stopping the engine E, through a second rotational position (engine-start position as shown in FIG. 3) P2 for allowing the engine E to be started and to a third rotational position (choke-activation position as shown in FIG. 4) P3 for activating a choke open/close mechanism 18. Thus, when an operator pushes a knob 14*a* of the rotatable body 14 frontward, for example, by the thumb of the operator's right hand gripping the grip portion 10*a*, the upper half portion of the rotatable body 14 is rotated away the grip portion 10*a* while the lower half portion of the rotatable body 14 is rotated to move forward the grip portion 10*a*. That is, the rotatable body 14 is rotated counterclockwise in FIG. 2.

As described in detail herein and with reference to FIGS. 5A–C, the interior space of the rear end portion of the handle houses the choke open/close mechanism 18 for opening and closing a choke valve 16 of a diaphragm-type carburetor 60, the throttle open/close mechanism 22 for opening and closing a throttle valve of the carburetor, and the interlock mechanism 24 for interlocking these mechanisms. In order to facilitate starting of the engine E when it is cold (i.e., during cold start), the choke open/close mechanism 18 is activated to close the choke valve 16. In this operation, the interlock mechanism 24 is operable to interlock the choke open/close mechanism 18 and the throttle open/close mechanism 22 to partially open the throttle valve so as to provide a slightly higher engine speed than the idling speed in the engine E.

Referring once again to FIG. 2, the interior space of the grip portion 10*a* is provided with a choke activation mechanism 26 for activating the choke open/close mechanism 18, and a release mechanism 28 for releasing the interlock mechanism 24.

With reference to FIGS. 5A–C, the choke open/close mechanism will be described in more detail. The choke open/close mechanism 18 includes the choke valve 16, a choke shaft 30 for rotating the choke valve 16, and a choke-activating arm member 32 fixedly attached at the outer end of the choke shaft 30 to extend in the crosswise (radial) direction of the choke shaft. The throttle open/close mechanism 22 includes the throttle valve 20, and a throttle shaft 34 for rotating the throttle valve 20.

With reference to FIG. 2, the choke activation mechanism 26 will be described in more detail. In the interior space of the handle 10, the choke activation mechanism 26 includes a choke-activating link member 36 adapted to be moved in the longitudinal direction X to transmit the movement of the rotatable body 14 to the choke-activating arm member 32 so as to close the choke valve 16. The choke-activating link member 36 has a distal end 36*a* coupled with the choke-actuating arm member 32 and a proximal end 36*b* coupled with the rotatable body 14, and extends between the distal and proximal ends. More specifically, the choke-activating link member 36 is one piece of elongated rod-shaped member (wire rod having rigidity and circular cross-section) extending from the rotatable body 14 to the choke-actuating arm member 32. The choke-activating link member 36 also has a shape in conformity with the shape of the interior space of the inverted-U-shaped handle 10. The choke-activating link member 36 includes a straight portion extending straight along the grip portion 10*a* of the handle 10 and a bent portion extending downward toward the choke-activating arm member 32 of the interlock mechanism 24, to form an L shape as a whole. In this embodiment, the choke-activating link member 36 is formed by bending an elongated rod-shaped member to have the above shape.

The rotatable body 14 is formed with an elongated slot 38 receiving the bent proximal end 36*b*. When the knob 14*a* of the rotatable body 14 is rotated to more across a click stop device 13 from the first position P1 to the second position P2, the proximal end 36*b* of the choke-activating link member 36 is allowed to be displaced relative to the rotatable body 14 along the elongated slot 38 so that the choke-activating link member 36 has substantially no movement relative to the main body 4 in the direction X. More specifically, the escape hole is an elongated slot. The elongated slot 38 has a leading end zone 38*a* which is located inward in the radial direction of the rotatable body 14 and on a leading side with respect to the counterclockwise rotation direction of the rotatable body 14, and a trailing end zone 38*b* which is located outward in the radial direction and on a trailing side with respect to the rotation direction. The elongated slot 38 extends obliquely with respect to the radial direction of the rotatable body 14 from the leading end zone 38*a* to the trailing end zone 38*b*. That is, in the side view of the rotatable body 14 shown in FIG. 2, the elongated slot 38 is located in the lower region of the circular rotatable body 14 and in the quarter region of the rotatable body on the trailing side of the counterclockwise rotation direction, and extends toward the trailing side of the counterclockwise rotation direction in the longitudinal direction X of the rod-shaped choke-activating link member 36, from the leading end zone 38*a* located obliquely downward with respect to the rotation center O of the rotatable body 14 to the trailing end zone 38*b*. The elongated slot 38 is slightly curved downward to form an arc shape.

The rotatable body 14 has a substantially circular shape as a whole, and the trailing end zone 38*b* is located to protrude radially outward from the peripheral portion of the circular rotatable body 14. That is, the rotatable body 14 is formed with a raised portion 50 (FIG. 2) protruding radially outward, and the elongated slot 38 extends up to the raised portion 50. On the other hand, the proximal end 36*b* of the choke-activating link member 36 is bent at a right angle. The bent portion is inserted into the elongated slot 38. The trailing end zone 38*b* of the elongated slot 38 is formed with a dent zone 38*c* for receiving therein the bent portion, on the leading side of the rotatable body 14.

A guide portion 40 is provided adjacent to the elongated slot 38. The guide portion 40 is adapted to guide the proximal end 36*b* of the choke-activating link member 36 from the leading end zone 38*a* to the trailing end zone 38*b* along the elongated slot 38 when the rotatable body 14 is moved from the first rotational position P1 to the second rotational position P2, and to hold the proximal end 36*b* of the choke-activating link member 36 at a constant position in the trailing end zone 38*b* of the elongated slot 38 when the rotatable body 14 is moved from the second rotational position P2 to the third rotational position P3. The guide portion 40 has a flat surface region 40*a* extending radially straight from the rotation center O of the circular rotatable body 14 up to the peripheral portion of the rotatable body 14, and an arc surface region 40*b* extending from the radially outer end of the flat surface region 40*a* to the leading side of the rotatable body 14 to form an arc having a second radial distance r2 inside the peripheral portion about the rotation center. Thus, the guide portion 40 has a substantially L-shaped surface. More specifically, the trailing end zone 38*b* is spaced apart from the rotation center O of the rotatable body 14 by a first radial distance r1. Further, in the guide portion 40, the flat surface region 40*a* extends straight in the radial direction of the rotatable body 14 up to a position of the second radial distance derived by subtracting the outside dimension of the bent proximal end 36*b* of the choke-activating link member 36 from the first radial distance, and the arc surface region 40*b* extends from the radially outer end of the flat surface region 40*a* to the leading side of the rotatable body 14 to form an arc having the radius r2 of the second radial distance about the rotation center O of the rotatable body 14.

The guide portion 40 is formed to protrude from the inner surface of the housing 4 in the front end region 10*b* of the handle 10. In the first rotational position P1, the proximal end 36*b* of the choke-activating link member 36 is located in the elongated slot 38 on the trailing side of the counterclockwise rotation direction with respect to the flat surface region 40*a*. When the rotatable body 14 is moved from the second rotational position P2 to the third rotational position P3, the proximal end 36*b* of the choke-activating link member 36 is moved along the flat surface region 40*a* and arc surface region 40*b*.

The interlock mechanism 24 will now be described with reference to FIGS. 5A–5C. The interlock mechanism 24 has a similar structure to that of auto-return choke devices of conventional carburetors, and thereby it will be described briefly. As can be seen from FIGS. 5A–5C, the choke-actuating arm member 32 is disposed adjacent to an after-mentioned throttle-releasing arm member 44. The interlock mechanism 24 comprises an engagement pawl 42*a* formed at the top of the rotation member 42 rotated integrally with the choke-activating arm member 32 attached at the outer end of the choke shaft, and another engagement pawl 44*a* formed at the top of the throttle-releasing arm member 44. These engagement pawls 42*a*, 44*a* are engaged with and disengaged from one another in response to the respective rotations of the choke shaft 30 and the throttle shaft 34 to act as the interlock mechanism 24.

The release mechanism 28 used for releasing the interlock mechanism 24 for interlocking the choke-valve open/close mechanism 18 and the throttle-valve open/close mechanism 22 will be described below. This release mechanism 28 is also similar to a conventional trigger-type throttle control device, and thereby it will be described briefly. The release mechanism 28 includes a sector-shaped trigger member 46 disposed on the lower surface side of the front end region of the grip 10*a* and swingably attached to the main body, the throttle-releasing arm member 44 attached to the throttle shaft 34, and a rod-shaped throttle-releasing link member 48 having a bent proximal end 48*b* attached to the trigger member 46 and a bent distal end 48*a* attached to the throttle-releasing arm member 44. The throttle-releasing link member 48 is one piece of elongated circular-sectional wire rod member extending from the trigger member 46 to the throttle-releasing link member 48, and has a shape in conformity with the interior space of the inversed-U-shaped handle 10. The throttle-releasing link member 48 includes a straight portion extending straight along the grip portion 10*a* of the handle 10, and a bend portion extending downward toward the throttle-releasing arm member 44 of the interlock mechanism 24, to form an L shape as a whole.

A safety hold lever 51 is provided on the upper surface of the front end region of the grip portion 10*a*. The safety hold lever 51 prevents the interlock mechanism 24 from being released by an unintentional operation of the trigger 46. The trigger member 46 can be pulled only if the safety hold lever 51 is being pushed while firmly gripping the grip portion 10*a*. The choke-activating link member 36 and the throttle-releasing link member 48 are disposed in parallel with one another in the interior space of the handle 10 without any interference therebetween.

As already described, the trailing end zone 38*b* of the elongated slot 38 is formed as the raised portion 50 protruding radially outward from the peripheral portion of the substantially circular rotatable body 14, as shown in FIG. 2. A movable switch terminal 52 is disposed adjacent to the raised portion 50. At a pushed position where the movable switch terminal 52 is pushed by the raised portion 50 (see FIG. 2), the movable switch terminal 52 is pressed onto a fixed switch terminal 53 protrudingly provided on the inner surface of the front end region 10*b* of the handle 10 to disenable the igniting function of the ignition unit. On the other hand, at a released position where the raised portion 50 is offset (see FIGS. 3 and 4), the igniting function of the ignition unit is enabled to allow the engine E to be started.

With reference to FIGS. 2 to 5C, the operations of the choke-valve open/close mechanism 18, the throttle-valve open/close mechanism 22, the interlock mechanism 24, the choke activation mechanism 26 and the release mechanism 28 will be described below.

As shown in FIG. 2, at an initial position, the operation unit 12 is located at the engine-stop position, and the rotatable body 14 is located at the first rotational position P1. In this state, the proximal end 36*b* of the choke-activating link member 36 is located at the leading end zone 38*a* of the elongated slot 38. On the other hand, as shown in FIG. 5A, the choke valve 16 of the choke open/close mechanism 18 is opened, the throttle valve 20 of the throttle open/close mechanism 22 being at an opening for an idling speed, and the interlock mechanism 24 is released. Further, as shown in FIG. 2, the movable switch terminal 52 is pushed by the raised portion 50 of the rotatable body 14, and thereby is brought into contact with the fixed switch terminal 53 to disenable the igniting function of the ignition unit.

Then, as shown in FIG. 3, when the operation unit 12 is moved to the engine-start position, the rotatable body 14 is rotated counterclockwise to pass over the click-stop device 13 from the first rotational position P1 to the second rotational position P2. When the rotatable body 14 is moved from the first rotational position P1 to the second rotational position P2, the elongated slot 38 is moved relative to the guide portion 40 toward the leading side while allowing the flat surface region 40*a* of the guide portion 40 to move across the elongated slot 38. The proximal end 36*b* of the choke-activating link member 36 is guided by the guide 40 to displace toward the trailing side up to the trailing end zone 38*b* along the elongated slot 38. When the rotatable body 14 is moved from the first rotational position P1 to the second rotational position P2, the proximal end 36*b* is allowed to displace along the escape hole (elongated slot) 38 to displace relative to and in the radial direction of the rotatable body 14 so as to cause only a small amount of swing movement of the choke-activating link member 36 about the distal end 36*a* thereof. That is, the distal end 36*a* has substantially no movement in the longitudinal direction. Thus, the choke open/close mechanism 18 is not activated, and maintained in the opened position as shown in FIG. 5A to allow the engine to be started.

Then, as shown in FIG. 4, when the operation unit 12 is moved to the choke-activation position under the condition of extremely low ambient temperature, the rotatable body 14 is rotated counterclockwise from the second rotational position P2 to the third rotational position P3. When the rotatable body 14 is moved from the second rotational position P2 to the third rotational position P3, the proximal end 36*b* of the choke-activating link member 36 is moved along the arc surface region 40*a* of the guide portion 40 while maintaining its position in the trailing end zone 38*b* of the elongated slot 38 located on the radial outside of the arc surface region 40*b* of the guide portion 40, so as to transmit the movement of the rotatable body 14 to the choke-activating arm member 32. Thus, as shown in FIG. 5A, the choke-activating arm member 32 is pushed to rotate the choke shaft 30 and consequently close the choke valve 16. Simultaneously, as shown in FIG. 5B, the engagement pawl 42*a* at the top of the rotation member 42 and the engagement pawl 44*a* at the top of the throttle-releasing arm member 44 are engaged with one another according to the rotation of the choke shaft 30. Thus, the throttle shaft 34 is rotated according to the rotation of the choke shaft 30 to partially open the throttle valve 20 (at an opening for increasing the idling speed) and maintained at this opening. Then, the engine E will be started by a recoil starter (not shown) provided in the main body 6.

Upon hearing an initial detonation sound, the operator returns the operation unit 12 from the choke-activation position (P3) to the engine-start position (P2). Through this operation, as shown in FIG. 5C, the choke-activating arm member 32 is pulled frontward by the choke-activating link member 36, and thereby swung to open the choke valve 16. In this state, the throttle valve 20 is maintained at the partial opening.

Then, by pulling the trigger member 46 while pushing the safety hold lever 51, the throttle-releasing link member 48 is moved frontward in the longitudinal direction X in response to the swing movement of the trigger member 46. Thus, the throttle-releasing arm member 44 is pulled and swung in response to the movement of the throttle-releasing link member 48 to release the engagement between the two engagement pawls 42*a*, 44*a* of the interlock mechanism 24, and thereby the throttle valve 20 is return to the opening position for the idling speed.

According to this embodiment, the stop, start and choke operations can be performed only by the single operation unit 12. In addition, the choke operation can be performed by the choke-actuating link member 36 comprised of a single rod-shaped member extending from the front end region 10*b* to the rear end region of the handle 10. This makes it possible to provide the chain saw 2 with a simplified structure, reduced number of components, enhanced workability during its assembly process and reduced cost.

Further, this embodiment allows the choke-activating link member 36 to be reliably guided along the elongated slot 38 by the guide portion 40. This can achieve reliable operation of the choke open/close mechanism 18.

Furthermore, in this embodiment, the choke-activation link member 36 is comprised of a rod-shaped member disposed in parallel with the throttle-activating link member 48. Thus, the choke-activation link member 36 does not interference with the throttle release mechanism, and thereby any need for design change of existing throttle control mechanisms will be eliminated.

The present invention is not limited to the above embodiment, and it will be evident that various modifications and changes may be made to the embodiment without departing from the spirit and scope of the present invention as set forth in the claims attached hereto. Accordingly, it is intended that all such modifications are to be encompassed by the present invention.

For example, in the above embodiment, based on the longitudinal direction X of the grip portion extending in the lengthwise direction of the working machine, the engine-stop position P1 is located rearward and the choke-activation position P3 is located frontward. Then, the operation unit is moved from the engine-stop position P1 to the choke-activation position P3 to rotate the rotatable body counter-clockwise in FIG. 2. Conversely, the operation unit may be moved from the engine-stop position P1 located frontward to the choke-activation position P3 located rearward. In this case, the escape hole or elongated slot 38 may be arranged such that: when the rotatable body 14 is rotated from the first rotational position P1 to the second rotational position P2, the proximal end 36*b* is allowed to displace relative to the rotatable body 14 along the elongated slot 38 without causing any movement of the choke-activating link member 36 in the longitudinal direction X; and when the rotatable body 14 is rotated from the second rotational position P2 to the third rotational position P3, the proximal end 36*b* is restricted in its displacement along the elongated slot 38 so that the choke-activating link member 36 is pushed in the longitudinal direction X in response to the movement of the rotatable body 14 to transmit the movement of the rotatable body 14 to the arm member 32. As long as the escape hole 38 is constructed in this manner, elongated slot 38 may be disposed at any position in the rotatable body 14.

What is claimed is:

1. A working machine including an internal combustion engine, said working machine comprising:

a single operation unit for switching between stop, start and choke operations of said engine, said operation unit including a rotatable body capable of being rotationally moved according to a manual operation;

a choke open/close mechanism for an intake system of said engine, said choke open/close mechanism including a choke valve, a choke shaft for rotating said choke valve, and an arm attached to said choke shaft; and a choke-activating link member adapted to be moved in its longitudinal direction to transmit the movement of said rotatable body to said arm so as to close said choke valve, said choke-activating link member having a distal end coupled with said arm and a proximal end coupled with said rotatable body and extending between said distal and proximal ends, wherein said rotatable body is adapted to be switchably moved in turn from a first rotational position for stopping said engine, through a second rotational position for allowing said engine to be started, to a third rotational position for activating said choke open/close mechanism, and said rotatable body is formed with an elongated slot which receives therein said proximal end such that when said rotatable body is rotated from said first rotational position to said second rotational position, said proximal end is allowed to displace relative to said rotatable body along said elongated slot without causing any movement of said choke-activating link member in said longitudinal direction, and when said rotatable body is rotated from said second rotational position to said third rotational position, said proximal end is restricted in its displacement along said elongated slot so that said choke-activating link member is moved in said longitudinal direction in response to the rotational movement of said rotatable body to transmit the movement of said rotatable body to said arm.

2. A working machine including an internal combustion engine serving as a power source therefor, said working machine comprising:

a single operation unit for switching between stop, start and choke operations of said engine, said operation unit including a rotatable body capable of being rotationally moved according to a manual operation;

a choke open/close mechanism for an intake system of said engine, said choke open/close mechanism including a choke valve, a choke shaft for rotating said choke valve, and an arm fixedly attached to said choke shaft; and a choke-activating link member adapted to be moved in its longitudinal direction to transmit the movement of said rotatable body to said arm so as to close said choke valve, said choke-activating link member having a distal end coupled with said arm and a proximal end coupled with said rotatable body and extending between said distal and proximal ends, wherein said rotatable body is adapted to be switchably moved in turn from a first rotational position for stopping said engine, through a second rotational position for allowing said engine to be started, to a third rotational position for activating said choke open/close mechanism, and said rotatable body is formed with an elongated slot which receives therein said proximal end such that when said rotatable body is rotated from said first rotational position to said second rotational position, said proximal end is allowed to displace relative to and in the radial direction of said rotatable body along said elongated slot so as to cause a swing movement of said choke-activating link member about said distal end, and when said rotatable body is rotated from said second rotational position to said third rotational position, said proximal end is restricted in its displacement along said elongated slot so that said choke-activating link member is moved in said longitudinal direction in response to the movement of said rotatable body to transmit the movement of said rotatable body to said arm.

3. A working machine including an internal combustion engine serving as a power source therefor, said working machine comprising:

a single operation unit for switching between stop, start and choke operations of said engine, said operation unit including a rotatable body capable of being rotationally moved according to a manual operation;

a choke open/close mechanism for an intake system of said engine, said choke open/close mechanism including a choke valve, a choke shaft for rotating said choke valve, and an arm attached to said choke shaft; and a choke-activating link member adapted to be moved in its longitudinal direction to transmit the movement of said rotatable body to said arm so as to close said choke valve, said choke-activating link member having a distal end coupled with said arm and a proximal end coupled with said rotatable body, said choke-activating link member extending in the crosswise direction with respect to said distal and proximal ends therebetween, wherein said rotatable body is adapted to be switchably moved in turn from a first rotational position for stopping said engine, through a second rotational position for allowing said engine to be started, to a third rotational position for activating said choke open/close mechanism, and said rotatable body is formed with an elongated slot extending in said crosswise direction, said elongated slot having a leading end zone located on a leading side with respect to the rotation direction of said rotatable body and a trailing end zone located on a trailing side with respect to said rotation direction, wherein said rotatable body is adapted to receive therein said proximal end such that:

when said rotatable body is located at said first rotational position, said proximal end is located in said leading end zone;

when said rotatable body is rotated from said first rotational position to said second rotational position, said proximal end is moved from said leading end zone to said trailing end zone while displacing relative to and in the radial direction of said rotatable body along said elongated slot to cause a swing movement of said choke-activating link member about said distal end; and when said rotatable body is rotated from said second rotational position to said third rotational position, said proximal end is held in said trailing end zone so that said choke-activating link member is pushed in said longitudinal direction in response to the movement of said rotatable body to transmit the movement of said rotatable body to said arm.

4. The working machine as defined in either one of claims 1 to 3, further comprising:

a throttle open/close mechanism for opening and closing a throttle valve of said intake system;

an interlock mechanism for interlocking said throttle open/close mechanism and said choke open/close mechanism; and a release mechanism including a release lever for releasing said interlock mechanism.

5. The working machine as defined in claim 4, wherein said operation unit and said release lever are disposed at the front end portion of a handle extending in the lengthwise direction of said working machine.

6. The working machine as defined in claim 4, wherein said choke open/close mechanism, said throttle open/close mechanism and said interlock mechanism are housed in an interior space of the rear end portion of said handle.

7. The working machine as defined in claim 4, wherein said choke-activating link member is comprised of a rod-shaped member extending from said rotatable body to said arm attached to said choke shaft, in said lengthwise direction through the internal space of said handle.

8. The working machine as defined in claim 4, wherein said release mechanism includes a rod-shaped throttle-releasing link member having a proximal end coupled with said release lever and a distal end coupled with said interlock mechanism, said throttle-releasing link member extending in said longitudinal direction through the interior space of said handle along said choke-activating link member.

9. The working machine as defined in claim 3, wherein said operation unit further includes a guide portion for guiding said proximal end of said choke-activating link member from said leading end zone to said trailing end zone along said elongated slot when said rotatable body is moved from said first rotational position to said second rotational position, and for holding said proximal end of said choke-activating link member in said trailing end zone when said rotatable body is moved from said second rotational position to said third rotational position.

10. The working machine as defined in claim 9, wherein said rotatable body has a substantially circular shape, wherein said leading end zone is located inward in the radial direction and on the leading side of said rotatable body, and said trailing end zone is located outward in the radial direction and on the trailing side of said rotatable body, said trailing end zone being spaced apart from the rotation center of said rotatable body by a first radial distance, and said elongated slot extending obliquely with respect to said radial direction from said leading end zone to said trailing end zone.

11. The working machine as defined in claim 10, wherein said guide portion has a flat surface region extending straight in the radial direction of said rotatable body up to a position of a second radial distance derived by subtracting the outside dimension of said proximal end of said choke-activating link member from said first radial distance, and an arc surface region extending from the radially outer end of said flat surface region to the leading side of the rotatable body to form an arc having a radius of said second radial distance about said rotation center, wherein when said rotatable body is located at said first rotational position, said proximal end of said choke-activating link member is located in said elongated slot on the trailing side with respect to said flat surface region, and when said rotatable body is moved from said first rotational position to said third rotational position, said proximal end of said choke-activating link member is moved along said flat surface and arc surface regions.

12. The working machine as defined in claim 4, wherein said operation unit further includes a guide portion for guiding said proximal end of said choke-activating link member from said leading end zone to said trailing end zone along said elongated slot when said rotatable body is moved from said first rotational position to said second rotational position, and for holding said proximal end of said choke-activating link member in said trailing end zone when said rotatable body is moved from said second rotational position to said third rotational position.

13. The working machine as defined in claim 12, wherein said rotatable body has a substantially circular shape, wherein said leading end zone is located inward in the radial direction and on the leading side of said rotatable body, said trailing end zone being located outward in the radial direction and on the trailing side of said rotatable body, said trailing end zone being spaced apart from the rotation center of said rotatable body by a first radial distance, and said elongated slot body extending obliquely with respect to said radial direction from said leading end zone to said trailing end zone.

14. The working machine as defined in claim 13, wherein said guide portion has a flat surface region extending straight in the radial direction of said rotatable body up to a position of a second radial distance derived by subtracting the outside dimension of said proximal end of said choke-activating link member from said first radial distance, and an arc surface region extending from the radially outer end of said flat surface region to the leading side of the rotatable body to form an arc having a radius of said second radial distance about said rotation center, wherein when said rotatable body is located at said first rotational position, said proximal end of said choke-activating link member is located in said elongated slot on the trailing side with respect to said flat surface region, and when said rotatable body is moved from said first rotational position to said third rotational position, said proximal end of said choke-activating link member is moved along said flat surface and arc surface regions.

15. The working machine as defined in either one of claims 1 to 3, further comprising:

a throttle open/close mechanism for opening and closing a throttle valve of said intake system;

an interlock mechanism for interlocking said throttle open/close mechanism and said choke open/close mechanism; and a release mechanism including a release lever for releasing said interlock mechanism, wherein said operation unit and said release lever are disposed at the front end portion of a handle extending in the lengthwise direction of said working machine, said choke open/close mechanism, said throttle open/close mechanism and said interlock mechanism being housed in an interior space of the rear end portion of said handle, said choke-activating link member being comprised of a rod-shaped member extending from said rotatable body to said arm attached to said choke shaft, in said lengthwise direction through the internal space of said handle, and said release mechanism including a rod-shaped throttle-releasing link member having a proximal end coupled with said release lever and a distal end coupled with said interlock mechanism, said throttle-releasing link member extending in said longitudinal direction through the interior space of said handle along said choke-activating link member.

16. The working machine as defined in claim 3, wherein said operation unit further includes a guide portion for guiding said proximal end of said choke-activating link member from said leading end zone to said trailing end zone along said elongated slot when said rotatable body is moved from said first rotational position to said second rotational position, and for holding said proximal end of said choke-activating link member in said trailing end zone when said rotatable body is moved from said second rotational position to said third rotational position, and said rotatable body has a substantially circular shape, wherein said leading end zone is located inward in the radial direction and on the leading side of said rotatable body, said trailing end zone is located outward in the radial direction and on the trailing side of said rotatable body, said trailing end zone being spaced apart from the rotation center of said rotatable body by a first radial distance, and said elongated slot body extending obliquely with respect to said radial direction from said leading end zone to said trailing end zone, wherein said guide portion has a flat surface region extending straight in the radial direction of said rotatable body up to a position of a second radial distance derived by subtracting the outside dimension of said proximal end of said choke-activating link member from said first radial distance, and an arc surface region extending from the radially outer end of said flat surface region to the leading side of the rotatable body to form an arc having a radius of said second radial distance about said rotation center, wherein when said rotatable body is located at said first rotational position, said proximal end of said choke-activating link member is located in said elongated slot on the trailing side with respect to said flat surface region, and when said rotatable body is moved from said first rotational position to said third rotational position, said proximal end of said choke-activating link member is moved along said flat surface and arc surface regions.

17. The working machine as defined in claim 15, wherein said operation unit further includes a guide portion for guiding said proximal end of said choke-activating link member from said leading end zone to said trailing end zone along said elongated slot when said rotatable body is moved from said first rotational position to said second rotational position, and for holding said proximal end of said choke-activating link member in said trailing end zone when said rotatable body is moved from said second rotational position to said third rotational position, and said rotatable body has a substantially circular shape, wherein said leading end zone is located inward in the radial direction and on the leading side of said rotatable body, said trailing end zone being located outward in the radial direction and on the trailing side of said rotatable body, said trailing end zone being spaced apart from the rotation center of said rotatable body by a first radial distance, and said elongated slot body extending obliquely with respect to said radial direction from said leading end zone to said trailing end zone, wherein said guide portion has a flat surface region extending straight in the radial direction of said rotatable body up to a position of a second radial distance derived by subtracting the outside dimension of said proximal end of said choke-activating link member from said first radial distance, and an arc surface region extending from the radially outer end of said flat surface region to the leading side of the rotatable body to form an arc having a radius of said second radial distance about said rotation center, wherein when said rotatable body is located at said first rotational position, said proximal end of said choke-activating link member is located in said elongated slot on the trailing side with respect to said flat surface region, and when said rotatable body is moved from said first rotational position to said third rotational position, said proximal end of said choke-activating link member is moved along said flat surface and arc surface regions.

* * * * *